US011576426B2

(12) United States Patent
Rushforth et al.

(10) Patent No.: US 11,576,426 B2
(45) Date of Patent: Feb. 14, 2023

(54) MODULAR TOBACCO INDUSTRY PRODUCT

(71) Applicant: British American Tobacco (Investments) Limited, London (GB)

(72) Inventors: David Rushforth, London (GB); Paul Blachford, London (GB)

(73) Assignee: BRITISH AMERICAN TOBACCO (INVESTMENTS) LIMITED, London (GB)

( * ) Notice: Subject to any disclaimer, the term of this patent is extended or adjusted under 35 U.S.C. 154(b) by 145 days.

(21) Appl. No.: 16/635,734

(22) PCT Filed: Jul. 30, 2018

(86) PCT No.: PCT/GB2018/052168
§ 371 (c)(1),
(2) Date: Jan. 31, 2020

(87) PCT Pub. No.: WO2019/025777
PCT Pub. Date: Feb. 7, 2019

(65) Prior Publication Data

US 2021/0120866 A1 Apr. 29, 2021

(30) Foreign Application Priority Data

Aug. 1, 2017 (GB) ..... 1712380

(51) Int. Cl.
*A24D 1/00* (2020.01)
*A24D 1/02* (2006.01)

(52) U.S. Cl.
CPC ..... *A24D 1/002* (2013.01); *A24D 1/02* (2013.01)

(58) Field of Classification Search
None
See application file for complete search history.

(56) References Cited

U.S. PATENT DOCUMENTS 3,614,956 A 10/1971 Thornton
4,903,712 A 2/1990 Strydom
(Continued)

FOREIGN PATENT DOCUMENTS

CA 2211571 1/1999
DE 1632226 11/1970
(Continued)

OTHER PUBLICATIONS

Definition of "kit", The Free Dictionary, [online], retrieved from the Internet, [retrieved Feb. 8, 2022], <URL:https://www.thefreedictionary.com/kit>. (Year: 2022).*
(Continued)

*Primary Examiner* — Dennis R Cordray
(74) *Attorney, Agent, or Firm* — Cantor Colburn LLP

(57) ABSTRACT

The present invention relates to a modular tobacco industry product (6). The modular tobacco industry product comprises a first rod (9) comprising a first smokeable material and a hollow channel (8), and a second rod (7) comprising a second smokeable material. The hollow channel is configured to receive the second rod, the second rod being insertable into the hollow channel by a consumer. The present invention also relates to a kit for assembling a modular tobacco industry product, a rod of smokeable material configured to be inserted into a hollow channel of a first rod, and a package.

10 Claims, 2 Drawing Sheets

(56) References Cited

U.S. PATENT DOCUMENTS

| | | | | |
|---|---|---|---|---|
| 4,917,121 | A | 4/1990 | Riehl | |
| 5,388,596 | A | 2/1995 | Schneider | |
| 5,433,224 | A | 7/1995 | Luke | |
| 5,712,377 | A | 2/1998 | Gerding | |
| 5,730,160 | A | 3/1998 | Schneider | |
| 8,267,095 | B2 | 9/2012 | Markel | |
| 8,282,739 | B2 * | 10/2012 | Mishra | A24D 1/002 131/274 |
| 8,393,335 | B1 | 3/2013 | Sinclair | |
| 8,448,646 | B2 | 5/2013 | Cooper | |
| 2006/0011205 | A1 | 1/2006 | Adiga | |
| 2007/0137667 | A1 | 6/2007 | Zhuang | |
| 2011/0259352 | A1 * | 10/2011 | Woodcock | A24D 1/02 131/335 |
| 2017/0064995 | A1 | 3/2017 | Beeson | |

FOREIGN PATENT DOCUMENTS

| | | | |
|---|---|---|---|
| EP | 0471581 | A1 | 2/1992 |
| GB | 2275410 | A | 8/1994 |
| WO | 2008022571 | A1 | 2/2008 |
| WO | 2010043475 | A1 | 4/2010 |
| WO | 2014132182 | A2 | 9/2014 |
| WO | 2016040580 | A1 | 3/2016 |

OTHER PUBLICATIONS

ISO 2965:2019—"Materials used as cigarette papers, filter plug wrap and filter joining paper, including materials having a discrete or oriented permeable zone and materials with bands of differing permeability—Determination of air permeability", [online], (Year: 2009).*

(V continued) retrieved from the Internet, [retrieved Feb. 8, 2022], <URL:https //www.iso.org/standard/73026.html. (Year: 2009).*

International Preliminary Report on Patentability for corresponding application PCT/GB2018/052168 filed Jul. 30, 2018; Report dated Feb. 4, 2020.

International Search Report for corresponding application PCT/GB2018/052168 filed Jul. 30, 2018; dated Nov. 6, 2018.

Written Opinion for corresponding application PCT/GB2018/052168 filed Jul. 30, 2018; dated Nov. 6, 2018.

* cited by examiner

MODULAR TOBACCO INDUSTRY PRODUCT

FIELD OF THE INVENTION

The present invention relates to a modular tobacco industry product.

BACKGROUND

Tobacco industry products generally comprise a tobacco rod surrounded by a wrapper and a filter aligned in an end to end relationship with the tobacco rod. Flavours or botanical materials, which alter the smoking experience for the consumer, can be located in the filter, the tobacco rod, or between the filter and the tobacco rod.

SUMMARY

According to a first aspect of the invention, there is provided a modular tobacco industry product comprising a first rod comprising a first smokeable material and a hollow channel, and a second rod comprising a second smokeable material, wherein the hollow channel is configured to receive the second rod, the second rod being insertable into the hollow channel by a consumer.

In some embodiments, the first smokeable material is different to the second smokeable material.

In some embodiments, the hollow channel extends along substantially the entire length of the first smokeable material.

In some embodiments, the hollow channel is substantially cylindrical in shape.

In some embodiments, the first rod further comprises a tubular element located around the periphery of the hollow channel.

In some embodiments, the first and/or the second smokeable material comprises a tobacco material.

In some embodiments, the second smokeable material comprises a botanical material.

In some embodiments, the second rod has an outer wrapper.

In some embodiments, the outer wrapper is permeable.

In some embodiments, the second rod is held within the hollow channel of the first rod by an interference fit.

In some embodiments, the modular tobacco industry product further comprises a filter element.

According to a second aspect of the invention, there is provided a kit for assembling a modular tobacco industry product, the kit comprising a first rod of a first smokeable material having a hollow channel and a second rod of a second smokeable material, wherein the hollow channel is configured to receive the second rod.

According to a third aspect of the invention, there is provided a rod comprising a smokeable material configured to be inserted into a hollow channel of a first rod of a first smokeable material.

In some embodiments, the rod according to the third aspect of the invention has a diameter of between 4 and 6 mm and a length of less than 70 mm.

In some embodiments, the rod according to the third aspect of the invention further comprises a permeable outer wrapper.

In some embodiments, the rod according to the third aspect of the invention does not comprise a filter.

According to a fourth aspect of the invention, there is provided a package comprising a first rod comprising a first smokeable material and a hollow channel and a second rod comprising a second smokeable material, wherein the hollow channel is configured to receive the second rod, the second rod being insertable into the hollow channel by a consumer.

BRIEF DESCRIPTION OF THE DRAWINGS

Embodiments of the invention will now be described, by way of example only, with reference to the accompanying drawings, in which.

DETAILED DESCRIPTION

Figure 1A:
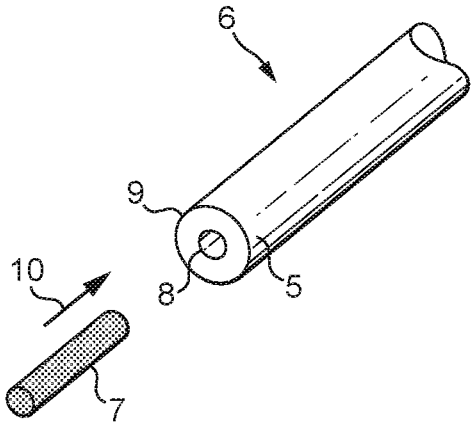
FIGS. 1*a*, 1*b*, and is show a modular tobacco industry product according to an embodiment of the present invention.

As used herein, the term "tobacco industry product" refers to any item made in, or sold by the tobacco industry, typically including a) cigarettes, cigarillos, cigars, tobacco for pipes or for roll-your-own cigarettes, (whether based on tobacco, tobacco derivatives, expanded tobacco, reconstituted tobacco or tobacco substitutes); b) non-smoking products incorporating tobacco, tobacco derivatives, expanded tobacco, reconstituted tobacco or tobacco substitutes such as snuff, snus, hard tobacco, and heat-not-burn (HnB) products; and c) other nicotine-delivery systems such as inhalers, aerosol generation devices including e-cigarettes, lozenges and gum. This list is not intended to be exclusive, but merely illustrates a range of products which are made and sold in the tobacco industry.

In some embodiments, the present invention relates to smoking articles. As used herein, the term "smoking article" includes smokeable products such as cigarettes, cigars and cigarillos whether based on tobacco, tobacco derivatives, expanded tobacco, reconstituted tobacco or tobacco substitutes and also heat-not-burn (HnB) products, and other nicotine delivery products such as aerosol generation devices including e-cigarettes. The smoking article may be provided with a filter for the gaseous flow drawn by the smoker.

A smoker typically has a preferred brand and type of cigarette. For example, a smoker may choose a specific type of cigarette because of, for example, the taste, the strength of tobacco or the length of time the cigarette may last. One of the most important features of a cigarette for the smoker is the taste. Taste varies greatly between different tobacco industry product brands. Cigarette manufacturers go to great lengths to ensure that a given product tastes the same, both throughout the year and from year to year. This ensures that tobacco industry products of a particular type have a consistent taste, providing the user with the comfort of knowing what to expect when smoking a new cigarette. Recently however, user interaction for selecting or altering the taste of a cigarette has become more prevalent. Users are more able to control the taste of the cigarette through, for example, capsules containing flavours such as menthol. A user is able to crush a flavour-containing capsule located within the filter of a cigarette prior to or during use to alter the taste. Capsules tend to provide distinctive non-tobacco flavours to tobacco industry products which the consumer is able to choose to add (by crushing the capsule) or not.

A smoker is typically unable to purchase a pack of cigarettes which have multiple flavours contained within it. Consumer studies have noted that smokers would like different taste experiences from their tobacco industry products for example at different times of the day. To achieve this, it would currently be necessary to purchase multiple different products. A user is unable to choose a different flavour after purchasing the pack, i.e. the user is stuck with their selection.

The present invention provides a modular tobacco industry product which is assembled by the user. In particular, the user is provided with a first rod comprising a first smokeable material and a second rod comprising a second smokeable material. The first rod comprises a hollow channel configured to receive the second rod. Thus, the user may select the second rod at the time of smoking the tobacco industry product. In some embodiments, the user may select a second rod to be inserted based on the nature of the second smokeable material, to provide a desired smoking experience.

When assembled, the modular tobacco industry product according to the present invention may appear to be substantially the same as a typical tobacco industry product. For example, the modular tobacco industry product may appear to be the same as a cigarette. The modular tobacco industry product may comprise a tobacco rod and a filter. According to the present invention, the tobacco industry product comprises the first rod and the second rod as defined in the claims. A user places the mouth end of the filter in his mouth and lights the free end of the tobacco rod. The filter may be of any typical construction. For example, the filter may comprise a plug of cellulose acetate which is used to filter substances out of the gaseous flow when the user draws through the mouth end.

Figure 1B:
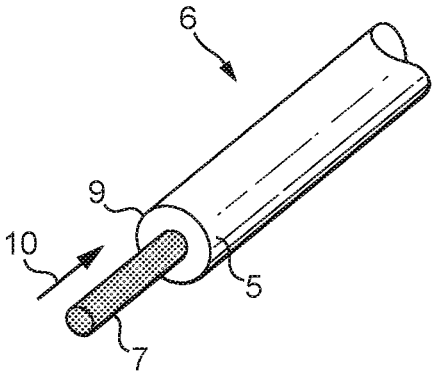
Figure 1C:
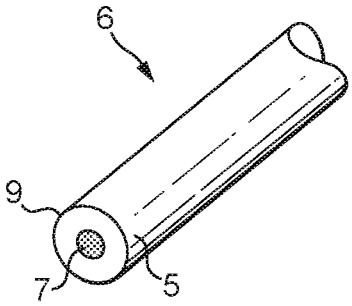

FIGS. 1*a*, 1*b*, and is show a modular tobacco industry product 6 according to an embodiment of the present invention. Specifically, the phases of inserting a second rod 7 into a hollow channel 8 of a first rod 9 are shown. The user assembles a tobacco industry product 6 by positioning an end of the second rod 7 adjacent to a free end 5 of the first rod 9, ensuring that the second rod 7 is in axial alignment with the hollow channel 8 of the first rod 9. Once the second rod 7 and the hollow channel 8 are axially aligned, the user pushes the first rod and second rod together 10, the second rod 7 sliding into the hollow channel 8. The user continues pushing until the second rod 7 is fully inserted into the hollow channel 8 of the first rod as shown in FIG. 1*c*.

In some embodiments, the second rod is longer than the hollow channel. When the second rod is longer than the hollow channel a portion of the second rod shall extend beyond the free end of the first rod when fully inserted into the hollow channel. Therefore, during use the user may only light the tip of the second rod, so as to only experience the taste from the second smokeable material until the burning coal at the end of the second rod contacts and ignites the smokeable material of the first rod, then providing the user with the full taste of both the first and second smokeable materials. Alternatively, the second rod may be shorter in length than the hollow channel. When the second rod is shorter than the hollow channel, the user is able to determine to what depth the second rod shall be inserted. For example, the user may slide the second rod into the hollow channel such that the end of the second rod and the end of the first rod are aligned. Alternatively, the user may slide the second rod further into the hollow channel such that the end of the second rod is located within the hollow channel to form a recess at the free end of the tobacco industry product. When the second rod is slid further into the hollow channel, the user may light only the first rod when initially lighting the tobacco industry product. During use, the coals shall move along the length of the first rod and ignite the second rod. When the second rod is not located at the open end of the first rod, the user may only experience the taste from the first smokeable material, until the second rod is ignited, providing the user with the full taste of both the first and second smokeable materials.

In some embodiments, the second rod is held in the hollow channel of the first rod by friction. In particular, the second rod may be retained within the hollow channel of the first rod by an interference fit. Alternatively, the second rod is held in the hollow channel by a locking mechanism such as a hook structure. In alternative embodiments, the second rod can be held in the hollow channel by an adhesive, such as glycerol, propylene glycol, or sugars. In some embodiments, once the second rod has been inserted into the hollow channel it cannot become dislodged or be removed. Preferably, once the second rod has been inserted into the hollow channel, the second rod is held in place throughout smoking the tobacco industry product.

The burn rate of each rod may be selected so that the rods burn evenly along the length of the assembled tobacco industry product. The user experiences a consistent mixture of smoke from the smokeable material of the first and second rods as the tobacco industry product is consumed.

Alternatively, the first and second rods may be selected to burn at different rates. For example, the second rod may burn more quickly than the first rod. When the second rod burns more quickly than the first rod, the consumer may experience a stronger effect from the second smokeable material during the initial puffs. In particular, the user may only experience an effect from the second smokeable material during the first, second, and third puffs of a cigarette. In some such embodiments the user may not experience any effect from the second smokeable material during the final one, two, three, four, or five puffs. Rather, the consumer may experience a more prolonged effect from the first smokeable material throughout the entire use of the tobacco industry product.

The first rod comprises a first smokeable material and a hollow channel.

In some embodiments, the first smokeable material comprises tobacco material. As used herein, "tobacco" refers to any smokeable material and includes, but is not limited to any part, e.g. leaves, leaf portions, flowers, roots, and stems, of any member of the genus *Nicotiana* and blends thereof, reconstituted tobacco, tobacco substituents, tobacco derivatives, dried fruits or herbs, and the like. In some embodiments, the tobacco material comprises any one or more of shredded tobacco, powdered tobacco, reconstituted tobacco, tobacco fibres, tobacco sheet, cut tobacco lamina, cut tobacco blend, expanded tobacco, and tobacco stem.

In some embodiments, the first rod comprises smokeable filler material comprising a blend of non-combustible inorganic filler material, a binder, and an aerosol generating means. Such filler material may be in the form of a cut or shredded sheet.

In some embodiments, the first rod comprises a means to retain the structure and shape of the rod, to prevent the hollow channel from collapsing during storage and transportation.

Figure 2:
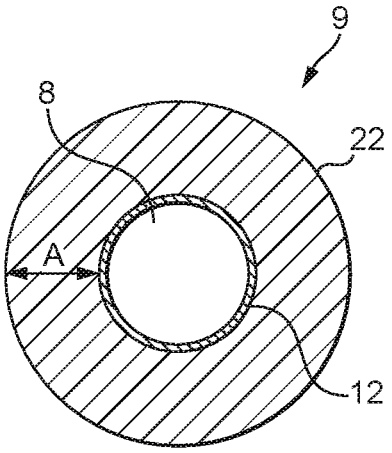
FIG. 2 shows a cross-sectional view of a first rod.

In some embodiments, the hollow channel is defined by a tubular element positioned along the length of the channel which acts as the means to retain the structure of the first rod and as a support. FIG. 2 shows a cross-section of first rod comprising a tube of a first smokeable material 22, a hollow channel 8, and a tubular element 12 located around the periphery of the hollow channel 8. When a tubular element is present along the length of the hollow channel, it may help prevent the first rod from collapsing prior to use. In addition, the tubular element may prevent fragments of the first smokeable material from being lost, e.g. during transportation and storage.

In some embodiments, the tubular element comprises a relatively flexible material, such as paper. The paper may comprise any paper typically used in the tobacco industry, for example paper typically used to circumscribe a cigarette. Alternatively, other cellulosic materials, or a sheet of reconstituted tobacco can be used. When a tubular element comprises a relatively flexible material, the first rod and/or the hollow channel may be deformable.

Alternatively, the tubular element may comprise a relatively rigid material. When the tubular element comprises a rigid material, the overall rigidity and hardness of the first rod may be increased. A suitable rigid material may comprise thick paper, double wrapped paper, cellulosic material, ceramic, or alginate. Furthermore, a rigid tubular element may prevent the hollow channel from being deformed either during transportation or during use. In some embodiments, the tubular element is resiliently deformable.

In some embodiments, the first rod is made by a standard annular or co-axial cigarette making process.

In some embodiments, the smokeable material of the first rod may have sufficient inherent structural integrity to prevent the hollow channel from collapsing in normal use. For example, the first smokeable material may comprise additives to increase its structural integrity, such as binders such as sugars and acacia gum. When the first smokeable material comprises additives which increase the structural integrity of the material, the hollow channel may keep its shape without requiring a support such as a tubular element as discussed above.

In some embodiments, the first smokeable material is extruded to provide a resilient material which is able to be deformed but which returns to its original shape. An extruded smokeable material may be provided by extruding a mixture of a smokeable material and a binding agent. Suitable binding agents include hydroxypropyl methyl cellulose, stem proteins, alginates, and gums.

Figure 3A:
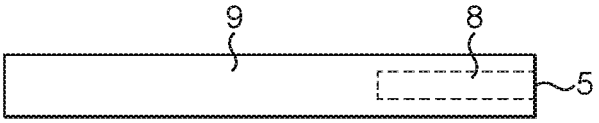
FIGS. 3*a* and 3*b* show a cross-sectional side view of a first rod.
Figure 3B:
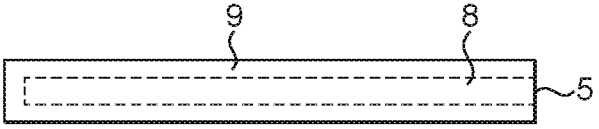

Turning now to FIGS. 3*a* and 3*b* a side view of a first rod 9 and varying lengths of hollow channel 8 are shown. For example, FIG. 3*a* illustrates a hollow channel 8 extending only partially along the length of the first rod 9. Alternatively, as shown in FIG. 3*b*, the hollow channel 8 may extend substantially the entire length of the first rod 9.

In some embodiments, the hollow channel extends partially along the length of the first rod. For example, the hollow channel extends to about 6 mm from the mouth end of the first rod, leaving a solid section comprising a first smokeable material in order to reduce the puff temperature profile.

In some embodiments, the second rod 7 is of the same length as the hollow channel 8. Therefore, when the hollow channel extends only partially along the length of the first rod, the second rod 7 may extend only partially along the length of the first rod 9. Alternatively, when the hollow channel extends substantially the entire length of the first rod, the second rod may extend along substantially the entire length of the first rod 9. Where the second rod 7 extends only partially along the length of the first rod 9, the user may only experience the taste from the smokeable material of the second rod 7 during the first initial puffs. Alternatively, when the second rod 7 extends substantially the entire length of the first rod 9, the user may experience the taste from the second smokeable material 7 until the final puff/few puffs. For example, until the final one, two, three, four, or five puffs.

In some embodiments, the external dimensions of the first rod 9 are the same as those of the rod of smokeable material of a standard king size cigarette. For example, the length of the first rod may be about 56 mm and the external diameter of the first rod may be about 7.8 mm. When the external dimensions of the first rod are the same as those of the rod of smokeable material of a standard king size cigarette, the hollow channel is preferably configured to receive a rod of tobacco the same size of a super slim cigarette. For example, the hollow channel may have a diameter of about 5.4 mm. Alternatively, the external dimensions of the first rod may be smaller than those of a king size cigarette, in which case the hollow channel may also be of a smaller diameter.

The distance A between the inner and outer radii of the first smokeable material forming the first rod, as shown in FIG. 2, may be about 2 mm, 3 mm, 4 mm, or 5 mm.

The second rod comprises a second smokeable material. In some embodiments, the second smokeable material is different to the first smokeable material. A modular tobacco industry product having a second rod comprising a different smokeable material to the first rod provides the user with a different taste when compared to a tobacco industry product having a single smokeable material in the tobacco rod.

The dimensions of the second rod are selected to allow insertion into the hollow channel of the first rod. In some embodiments, the second rod has the same length as the hollow channel of the first rod. In some embodiments, the diameter of the second rod allows insertion into the hollow channel of the first rod with an interference fit.

In some embodiments the diameter of the second rod is the same as that of a standard super slim cigarette. For example, the diameter of the second rod may be about 5.4 mm.

In some embodiments the second rod comprises tobacco material, such as any one or more of those discussed above for use in the first rod. In some embodiments, the second smokeable material may comprise a botanical material. Any suitable botanical material may be employed in the modular tobacco industry product. Botanical materials include powder, dust, crushed particles, granules, pellets, shreds, strips, sheets, or the like comprising one or more of: leaf, stems, seeds, root, bark, flower, fragments or ribs of homogenised botanical, reconstituted botanical, processed botanical, extruded botanical, expanded botanical, and the like. Botanical material may comprise tea, peppermint, spearmint, cocoa, laurel, eucalyptus, geranium, basil, sage, verbena, tarragon, and spices, such as cinnamon, clove, and ginger.

In some embodiments, the first rod comprises a botanical material such as any one or more of those discussed above for use in the second rod.

In some embodiments, the second rod comprises flavours derived from tobacco leaf, stem or root, or any other natural or synthetic flavour.

In some embodiments, the second rod comprises a tobacco material and a botanical material.

In some embodiments, the second rod is prepared by extrusion or a standard method used to prepare super slim tobacco industry products.

Figure 4:
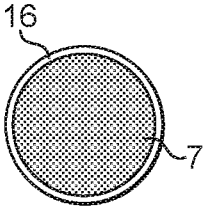
FIG. 4 shows a cross-sectional view of a second rod.

In some embodiments, the second rod 7 includes an outer wrapper 16, as shown in FIG. 4. In some embodiments, the second rod comprises an outer wrapper of paper, such as paper suitable for circumscribing a rod of smokeable material in a conventional tobacco industry product, ceramics, alginates, reconstituted tobacco, smokeable filler material comprising a blend of non-combustible inorganic filler material in the form of a sheet or cut or shredded sheet, a binder, and an aerosol generating means, or a co-extrusion sheet. The wrapping paper may allow the second rod to be more easily inserted into the hollow channel of the first rod. In some embodiments, the outer wrapper may help protect the second rod when the user is inserting it into the hollow channel. For example, the presence of a wrapper may provide additional support to the second rod and therefore reduce the possibility of damage to the second rod upon insertion into the hollow channel of the first rod. The presence of a wrapper may provide a smooth surface to make sliding the second rod into the hollow channel easier. Once the second rod is inserted into the hollow channel, the first rod shall help to prevent damage to the second rod.

In some embodiments, the outer wrapper of the second rod is permeable. When the outer wrapper is permeable, smoke generated from burning the second smokeable material may be able to pass into the first rod and may therefore be combined with smoke generated from burning the first smokeable material.

Furthermore, in some embodiments, the second rod has an outer wrapper which provides the user with information regarding the nature of the second smokeable material. For example, the wrapper may have a visual marking, such as a colour, design or words, indicating what the second smokeable material is. A package could therefore include numerous second rods, each of which may be made from a different smokeable material. An outer wrapper on the second rod indicating which smokeable material the rod is made out of would provide the user with a reference for selecting the desired second rod.

In some embodiments, the hollow channel and second rod are cylindrical in shape. In some embodiments, the hollow channel and the first rod may be coaxial.

In some embodiments, each of the hollow channel and the second rod are in the shape of a cross, star, square, or comprise a ribbed surface.

In some embodiments, the modular tobacco industry product may further comprise a filter at the mouth end of the tobacco industry product. In particular, the filter may be located at the end of the first rod which is opposite the end which the second rod is inserted from.

The filter may comprise an adsorbent material. The filter may comprise multiple filter elements or filter sections to form, for example, a dual or triple filter. Suitable filters are well known to the person skilled in the art. Such filters known in the art include Dalmatian filters in which a particulate adsorbent material is interspersed in fibrous filter material, for example fibrous cellulosic material, and cavity filters in which a cavity portion of the multi-segment filter contains adsorbent material.

As used herein, the terms "flavour" and "flavourant" refer to materials which, where local regulations permit, may be used to create a desired taste or aroma in a product for adult consumers. They may include extracts (e.g., licorice, hydrangea, Japanese white bark magnolia leaf, chamomile, fenugreek, clove, menthol, Japanese mint, aniseed, cinnamon, herb, wintergreen, cherry, berry, peach, apple, Drambuie, bourbon, scotch, whiskey, spearmint, peppermint, lavender, cardamon, celery, cascarilla, nutmeg, sandalwood, bergamot, geranium, honey essence, rose oil, vanilla, lemon oil, orange oil, cassia, caraway, cognac, jasmine, ylang-ylang, sage, fennel, piment, ginger, anise, coriander, coffee, or a mint oil from any species of the genus *Mentha*), flavour enhancers, bitterness receptor site blockers, sensorial receptor site activators or stimulators, sugars and/or sugar substitutes (e.g., sucralose, acesulfame potassium, aspartame, saccharine, cyclamates, lactose, sucrose, glucose, fructose, sorbitol, or mannitol), and other additives such as charcoal, chlorophyll, minerals, botanicals, or breath freshening agents. They may be imitation, synthetic or natural ingredients or blends thereof. They may be in any suitable form, for example, oil, liquid, or powder.

In order to address various issues and advance the art, the entirety of this disclosure shows by way of illustration various embodiments in which the claimed invention(s) may be practiced. The features of the disclosure are of a representative sample of embodiments only, and are not exhaustive and/or inclusive. They are presented only to assist in understanding and teach the claimed features. It is to be understood that advantages, embodiments, examples, functions, features, structures and/or other aspects of the disclosure are not to be considered limitations on the disclosure as defined by the claims or limitation on equivalents to the claims, and that other embodiments may be utilised and modifications may be made without departing from the scope and/or spirit of the disclosure. Various embodiments may suitably comprise, consist of, or consist essentially of, various combinations of the disclosed elements, components, features, parts, steps, means, etc. In addition, the disclosure includes other inventions not presently claimed, but which may be claimed in future.

The invention claimed is:

1. A modular tobacco industry product comprising a first rod comprising a first smokeable material and a hollow channel, and a second rod comprising a second smokeable material, wherein the hollow channel is configured to receive the second rod, the second rod being insertable into the hollow channel by a consumer wherein the first rod further comprises a tubular element located around the periphery of the hollow channel, wherein the tubular element comprises paper, wherein the hollow channel extends along substantially the entire length of the first smokeable material.

2. A modular tobacco industry product according to claim 1, wherein the first smokeable material is different than the second smokeable material.

3. A modular tobacco industry product according to claim 1, wherein the hollow channel is substantially cylindrical in shape.

4. A modular tobacco industry product according to claim 1, wherein the first and/or the second smokeable material comprises a tobacco material.

5. A modular tobacco industry product according to claim 1, wherein the second smokeable material comprises a botanical material.

6. A modular tobacco industry product according to claim 1, wherein the second rod has an outer wrapper.

7. A modular tobacco industry product according to claim 6, wherein the outer wrapper is permeable.

8. A modular tobacco industry product according to claim 1, wherein the second rod is configured to be held within the hollow channel of the first rod by an interference fit.

9. A modular tobacco industry product according to claim 1, further comprising a filter element.

10. A package comprising a modular tobacco industry product according to claim 1, the package comprising a first rod comprising a first smokeable material and a hollow channel and a second rod comprising a second smokeable material, wherein the hollow channel is configured to receive the second rod, the second rod being insertable into the hollow channel by a consumer, wherein the first rod further comprises a tubular element located around the periphery of the hollow channel, and wherein the tubular element comprises paper.

* * * * *